US011504757B2

(12) United States Patent
Jung

(10) Patent No.: US 11,504,757 B2
(45) Date of Patent: Nov. 22, 2022

(54) APPARATUS AND METHOD FOR FORMING ALUMINUM PLATE

(71) Applicants: Hyundai Motor Company, Seoul (KR); Kia Motors Corporation, Seoul (KR)

(72) Inventor: Youn-Il Jung, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 462 days.

(21) Appl. No.: 16/179,954

(22) Filed: Nov. 4, 2018

(65) Prior Publication Data

US 2019/0168277 A1 Jun. 6, 2019

(30) Foreign Application Priority Data

Dec. 5, 2017 (KR) ..... 10-2017-0165764

(51) Int. Cl.
*B21D 22/02* (2006.01)
*B21D 37/16* (2006.01)
*B21D 22/20* (2006.01)

(52) U.S. Cl.
CPC ..... *B21D 22/022* (2013.01); *B21D 22/208* (2013.01); *B21D 37/16* (2013.01)

(58) Field of Classification Search
CPC .... B21D 22/0222; B21D 22/02; B21D 37/16; B21D 22/208; B21D 37/10; H05B 3/0057; H05B 3/0004; C21D 1/40; C21D 1/673; C25D 5/22
See application file for complete search history.

(56) References Cited

U.S. PATENT DOCUMENTS 6,463,779 B1 * 10/2002 Terziakin ..... B21D 37/16 148/567
2008/0257007 A1 * 10/2008 Golovashchenko ... B21D 37/16 72/342.96
2015/0183019 A1 * 7/2015 Kim ..... H05B 3/0004 72/342.96

(Continued)

FOREIGN PATENT DOCUMENTS

CN 106475475 A * 3/2017 ..... B21D 37/16
DE 890035 C 9/1953

(Continued)

OTHER PUBLICATIONS

"Extended European Search Report issued in European Application No. 18205624.2", dated May 2, 2019, 9 pages.

(Continued)

*Primary Examiner* — Adam J Eiseman
*Assistant Examiner* — Bobby Yeonjin Kim
(74) *Attorney, Agent, or Firm* — Fox Rothschild LLP

(57) ABSTRACT

An apparatus for forming an aluminum plate is provided. The apparatus includes an upper die that has a bottom surface that corresponds to a top shape of a product shape to be formed and descends by a press to press the aluminum plate. The apparatus also includes a lower die that has an upper surface that corresponds to a bottom shape of the product shape and an electrode unit that is inserted into the lower die and is exposed on the upper surface of the lower die to apply a current to a bent portion of the product shape.

11 Claims, 20 Drawing Sheets

(56) References Cited

U.S. PATENT DOCUMENTS

2017/0021404 A1* 1/2017 Kim ..... B21D 22/02

FOREIGN PATENT DOCUMENTS

| | | | | |
|---|---|---|---|---|
| JP | H 07-155856 | A | | 6/1995 |
| JP | 2009142854 | A | | 7/2009 |
| KR | 20140118337 | A | | 10/2014 |
| KR | 101487469 | B1 | | 1/2015 |
| KR | 20150078769 | A | | 7/2015 |
| KR | 20150078771 | A | | 7/2015 |
| KR | 20150078772 | | | 7/2015 |
| KR | 20150078772 | A | | 7/2015 |
| KR | 10-1577333 | B1 | | 12/2015 |
| KR | 101586571 | B1 | | 1/2016 |
| KR | 20160038133 | A | | 4/2016 |
| KR | 10-2016-0052858 | A | | 5/2016 |
| KR | 20160080465 | | | 7/2016 |
| KR | 20160080465 | A | | 7/2016 |
| KR | 101676392 | B1 | | 11/2016 |
| KR | 20160139572 | A | | 12/2016 |
| KR | 20170064272 | A | * | 6/2017 |

OTHER PUBLICATIONS

Chinese Second Office Action received for Chinese Application No. 201811398949.6, dated Jan. 28, 2022, 12 pages (5 pages of English Translation and 7 pages of Original Copy).
Office Action from Chinese Patent Application No. 201811398949.6 dated Jan. 28, 2022, 5 pages.

* cited by examiner

APPARATUS AND METHOD FOR FORMING ALUMINUM PLATE

CROSS-REFERENCE TO RELATED APPLICATION

This application claims priority to Korean Patent Application No. 10-2017-0165764, filed on Dec. 5, 2017, which is incorporated herein by reference in its entirety.

BACKGROUND

Field of the Disclosure

The present disclosure relates to an apparatus and a method for forming an aluminum plate by a press process, and more particularly to forming an aluminum plate while applying an electrical current.

Description of Related Art

A press process for processing parts using an aluminum plate at room temperature includes mounting a die on a press and pressing the die in a predetermined shape in a vertical direction, trimming a part which is not required for a final product, piercing processing apertures, etc., flanging additional shapes, and the like. The processes are collectively referred to as a stamping process and in general, a finished panel is produced by an average of four processes such as forming, cutting, hole processing, and bending. A forming process is a process of plastic-processing a steel plate based on product design data and determines a quality of a final product.

As illustrated in FIG. 1, in the stamping of the related art, a lower die 4 having a bottom shape is mounted on a lower bolster 5, and an upper die 3 having a top shape of the product is mounted on a slide 2 which is an upper press body disposed above the lower die 4, and as a result, while the steel plate is inserted to the lower die 4, the product is formed in close contact with the steel plate to press the steel plate.

Referring to the process of the related art shown in FIG. 2A through FIG. 2D, when a conventional die is used in the forming process, the lower die 4 having the bottom shape of the product is mounted on the lower bolster 5 and a blank holder 8 is mounted on the lower bolster 5 through a cushion pin 9 outside the lower die 4. In addition, as illustrated in FIG. 2A, the upper die 3 having the top shape of the product is mounted on the slide 2 which is the upper press body disposed above the lower die 4. As a result, while a blank 11 inserted to the lower die 4 is suspended (e.g., supported) on the blank holder 8, the blank 11 is pressed from the top and formed into the product shape. In other words, as illustrated in FIG. 2B, first, when the blank 11 is inserted between the upper die 3 and the lower die 4 while the upper die 3 and the blank holder 8 ascend, the upper die 3 descends, and as a result, an outer perimeter of the blank 11 is held by an upper face plane 6 and a blank holder face plane 7.

In such a state, as illustrated in FIG. 2C, the upper die 3 and the blank holder 8 descend together and the blank 11 held on each of the face planes 6 and 7 of the upper die 3 and the blank holder 8, respectively, is formed while gradually flowing into a forming part, and product forming is completed when the upper die 3 abuts the lower die 4. As illustrated in FIG. 2D, while the upper die 3 ascends, the blank 11 of which forming is completed is lifted by the blank holder 8 and transported from a press equipment by a take-out hanger 12.

The transported material is then subjected to processes including trimming, piercing, flanging, and the like and thereafter, seated on other components and an assembly jig to be assembled through welding and manufactured as a finished product.

The aluminum plate has a lower elongation at the same strength than the steel plate as illustrated in FIG. 3. In other words, the aluminum sheet (5000-series) is equivalent to about ½ the elongation of the same strength steel sheet. To overcome the low formability of an aluminum plate, a warm forming process is also used, in which, as illustrated in FIG. 4, the forming is performed while the material is heated to a particular temperature in addition to the above-mentioned press process.

In the process of forming the aluminum plate while the aluminum plate is heated to 350 to 400° C., which is a temperature at which the formability is enhanced, a stamping process is performed when a temperature of the aluminum plate is increased to a target temperature by maintaining an atmosphere temperature at 350 to 400° C. by high-temperature gas in a sealed state as illustrated in FIGS. 5A and 5B. The process thereafter is the same as a stamping process in a room-temperature state.

The aluminum plate is widely used as component materials of automobile vehicle, etc., due to an advantage such as a light weight, but since the elongation (e.g., the stamping formability) is low compared with the steel plate of the same strength as described above, a crack occurs during to the forming with a room-temperature press processing, and as a result, forming is difficult. For this reason, a product shape is significantly modified or the warm forming described above is used for forming the aluminum plate. In the warm forming, since the entire aluminum plate is heated uniformly by the high-temperature gas and the forming is performed thereafter, a processing speed is slow, and as a result, cost significantly increases and efficiency is reduced.

The above information disclosed in this section is merely for enhancement of understanding of the background of the disclosure and therefore it may contain information that does not form the prior art that is already known to a person of ordinary skill in the art.

SUMMARY

The present disclosure provides an apparatus and a method for forming an aluminum plate, which enable warming forming by enhancing a process speed and reducing cost.

In accordance with an exemplary embodiment of the present disclosure, an apparatus for forming an aluminum plate may include an upper die having a bottom surface that corresponds to a top shape of a product shape to be formed and configured to descend by a press to press the aluminum plate; a lower die having a top surface that corresponds to the bottom shape of the product shape; and an electrode unit inserted into the lower die and exposed on the upper surface of the lower die to apply a current to a bent portion of the product shape.

In particular, the electrode unit may include a positive (+) electrode and a negative (−) electrode, and the negative (−) electrode may be exposed to the upper surface of the lower die at a portion that corresponds to the bent surface of the product shape. In addition, the negative (−) electrode may include a first negative (−) electrode and a second negative (−) electrode, and each of the first negative (−) electrode and the second negative (−) electrode may be arranged to be electrically connected with one positive (+) electrode. The positive (+) electrode and the negative (−) electrode may be surrounded by an insulator and inserted into the lower die. Further, a plurality of positive (+) electrodes may be provided, and a distance between the plurality of positive (+) electrodes may be greater than a distance between each positive (+) electrode and a negative (−) electrode disposed to correspond to each positive (+) electrode.

Meanwhile, when a length of the bent surface is x, the first negative (−) electrode may be exposed on the upper surface of the lower die at a first position that corresponds to a point of about 0.26× to 0.4× from an upper end of the bent surface. In addition, when the length of the bent surface is x, the second negative (−) electrode may be exposed on the upper surface of the lower die at a second position that corresponds to a point of about 0.66× to 0.83× from the upper end of the bent surface.

In accordance with another aspect of the present disclosure, a method for forming an aluminum plate may include seating an aluminum plate on a lower die having an upper surface that corresponds to a bottom shape of a product shape to be formed; lowering an upper die having a lower surface that corresponds to a top shape of the product shape and pressing the aluminum plate seated on the lower die; applying a primary current through an electrode inserted into the lower die and exposed on the upper surface of the lower die at a portion that corresponds to a bent surface of the product shape, at a first time during the pressing of the aluminum plate; and applying a secondary current through the electrode at a second time during pressing of the aluminum plate.

The electrode may include a positive (+) electrode and a negative (−) electrode, and the negative (−) electrode may include a first negative (−) electrode and a second negative (−) electrode to correspond to the positive (+) electrode. Further, in the applying the primary current, the primary current may be applied by electrically connecting the positive (+) electrode and the first negative (−) electrode, and in the applying the secondary current, the secondary current may be applied by electrically connecting the positive (+) electrode and the second negative (−) electrode. In addition, in the applying the primary current, the primary current may be applied when a progress rate of the pressing of the aluminum plate is about 26 to 40% with respect to a completion of the product forming. Further, in the applying the primary current, the primary current may be applied about 2 to 3 seconds after the upper die descends. In particular, a current of about 120 to 140 A/mm$^2$ may be applied for about 0.5 to 0.9 seconds.

Furthermore, in the applying the secondary current, the secondary current may be applied when the progress rate of the pressing of the aluminum plate is about 66 to 83% with respect to the completion of the product forming. In addition, in the applying the secondary current, the secondary current may be applied about 4 to 5 seconds after the upper die descends. In particular, a current of about 120 to 140 A/mm$^2$ may be applied for about 0.5 to 0.9 seconds.

Meanwhile, when a length of the bent surface is x, the first negative (−) electrode may be exposed on the upper surface of the lower die at a first position that corresponds to a point of about 0.26× to 0.4× from an upper end of the bent surface. In addition, when the length of the bent surface is x, the second negative (−) electrode may be exposed on the upper surface of the lower die at a second position that corresponds to a point of about 0.66× to 0.83× from the upper end of the bent surface.

BRIEF DESCRIPTION OF THE DRAWINGS

A brief description of each drawing is provided to more sufficiently understand drawings used in the detailed description of the present invention.

DETAILED DESCRIPTION

In order to appreciate the present disclosure, operational advantages of the present disclosure, objects achieved by exemplary embodiments of the present disclosure, accompanying drawings that illustrate the exemplary embodiments of the present disclosure and contents disclosed in the accompanying drawings should be referred. In describing the exemplary embodiments of the present disclosure, it is to be understood that the present disclosure is not limited to the details of the foregoing description and the accompanying drawings.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

A method for forming an aluminum plate according to an exemplary embodiment of the present disclosure may apply a principle that an elongation is restored to an original material level by applying current for a short duration while the aluminum plate is deformed to perform a forming process without modifying a shape of a part.

Figure 1:
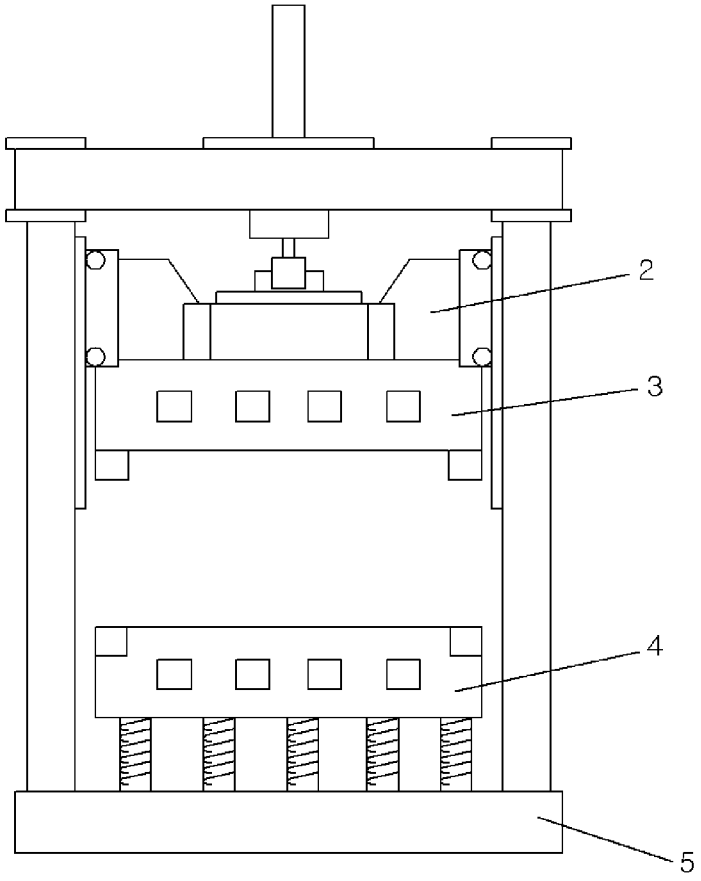
FIG.1 (RELATED ART)
FIG. 1 illustrates a general stamping equipment for forming in the related art.
Figure 2A:
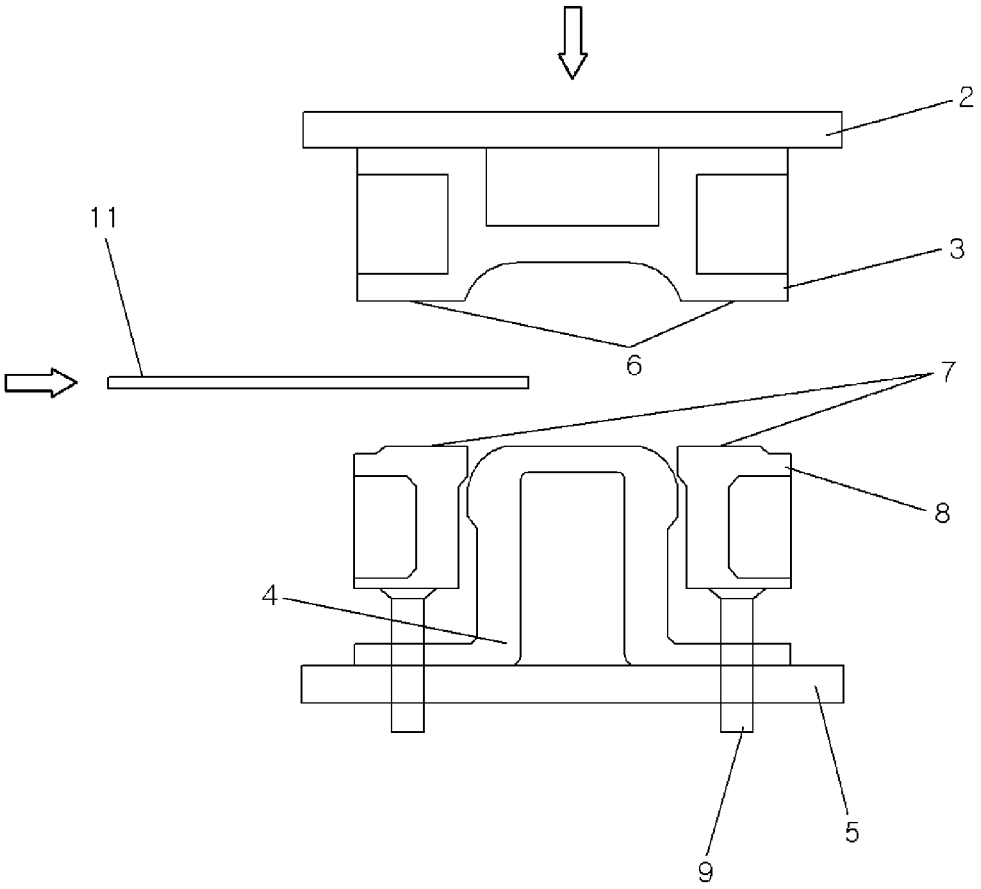
FIG.2A (RELATED ART)
FIGS. 2A to 2D illustrate a process by the general stamping equipment in the related art.
Figure 2B:
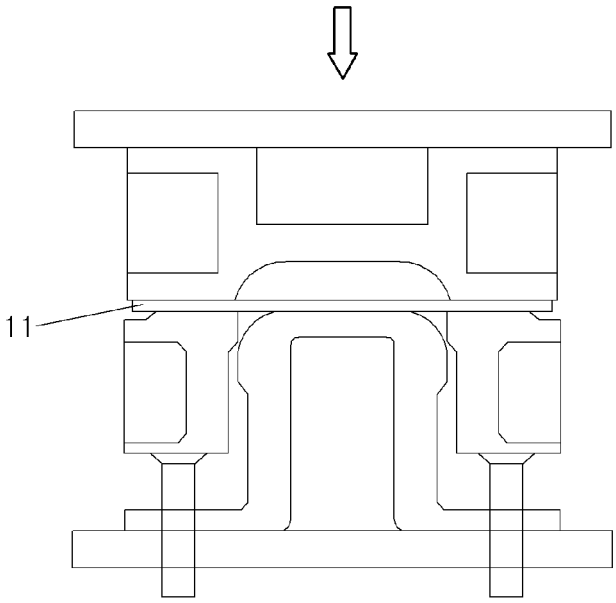
FIG. 2B Related Art
Figure 2C:
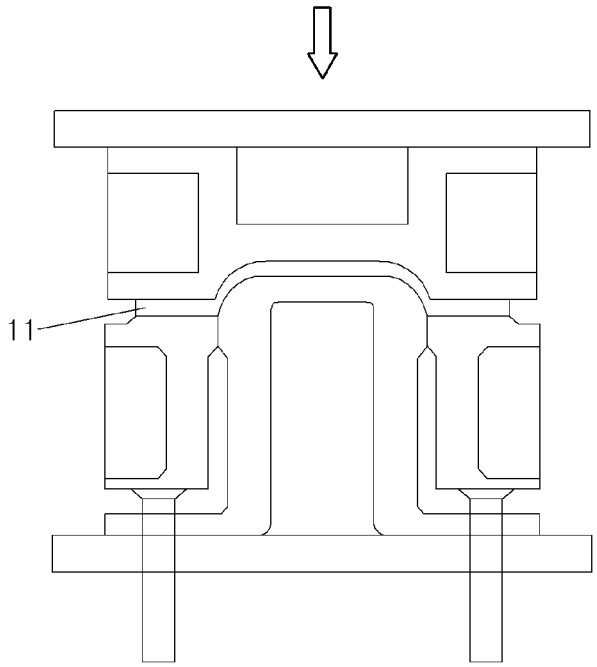
FIG. 2C Related Art
Figure 2D:
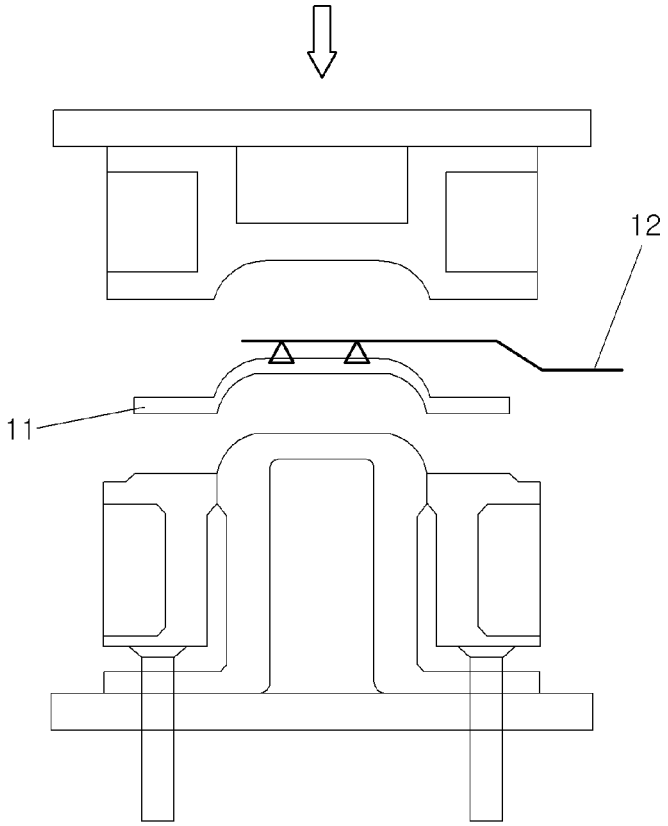
FIG. 2D Related Art
Figure 3:
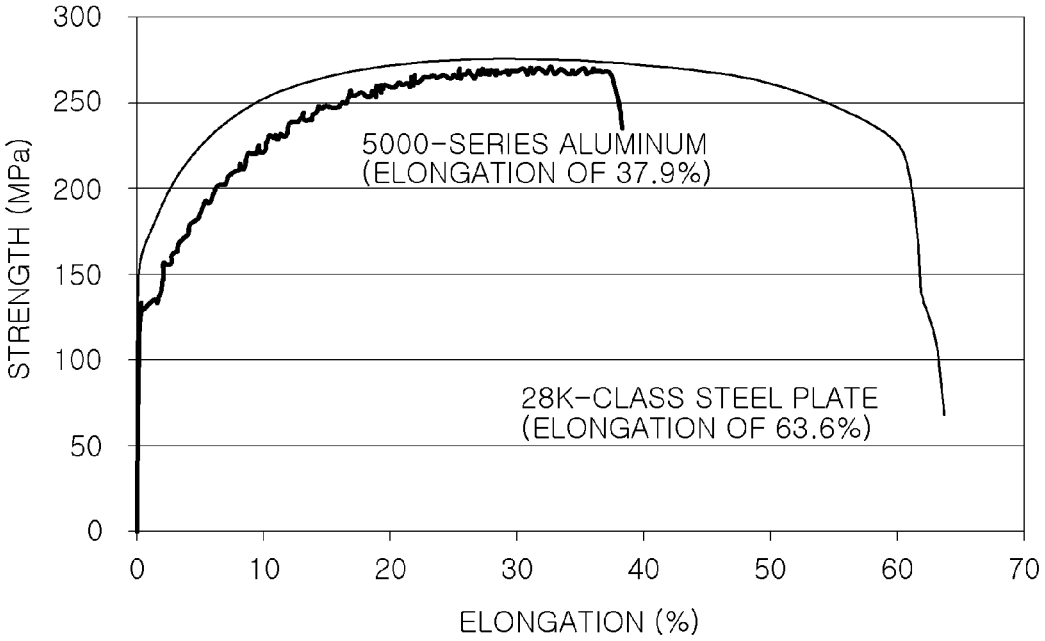
FIG. 3 Related Art
FIG. 3 illustrates a comparison of an elongation of an aluminum plate compared with a steel plate in the related art.
Figure 4:
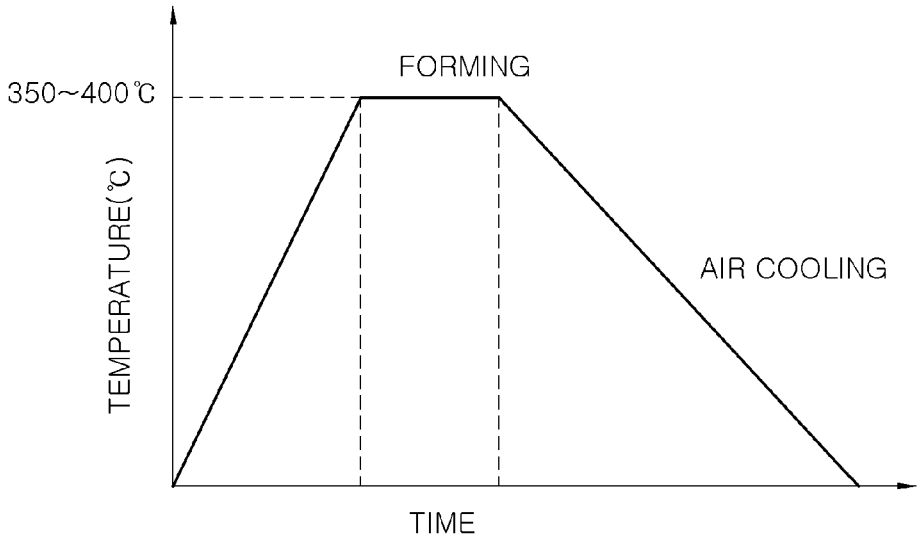
FIG. 4 Related Art
FIG. 4 illustrates a relationship of a temperature depending on time in the case of warm forming of the aluminum plate in the related art.
Figure 5A:
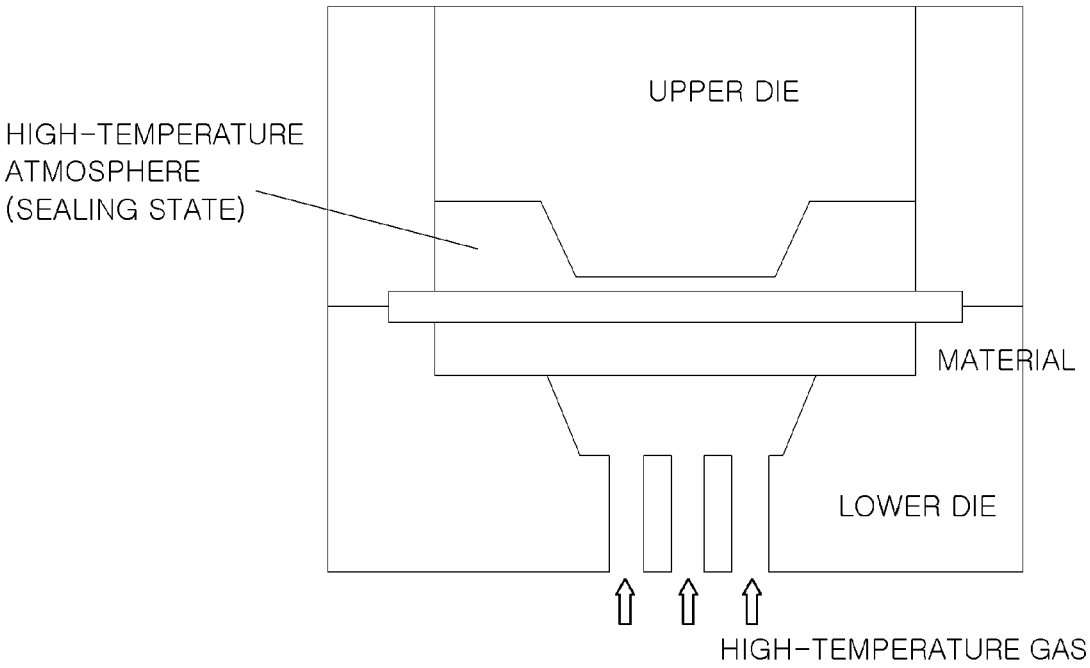
FIG. 5A Related Art
FIGS. 5A and 5B illustrate a warm forming process of an aluminum plate in the related art.
Figure 5B:
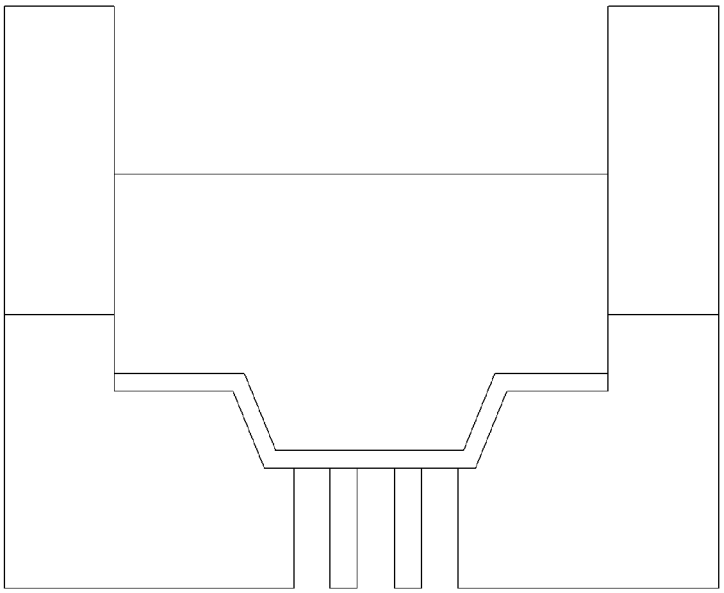
FIG. 5B Related Art
Figure 6:
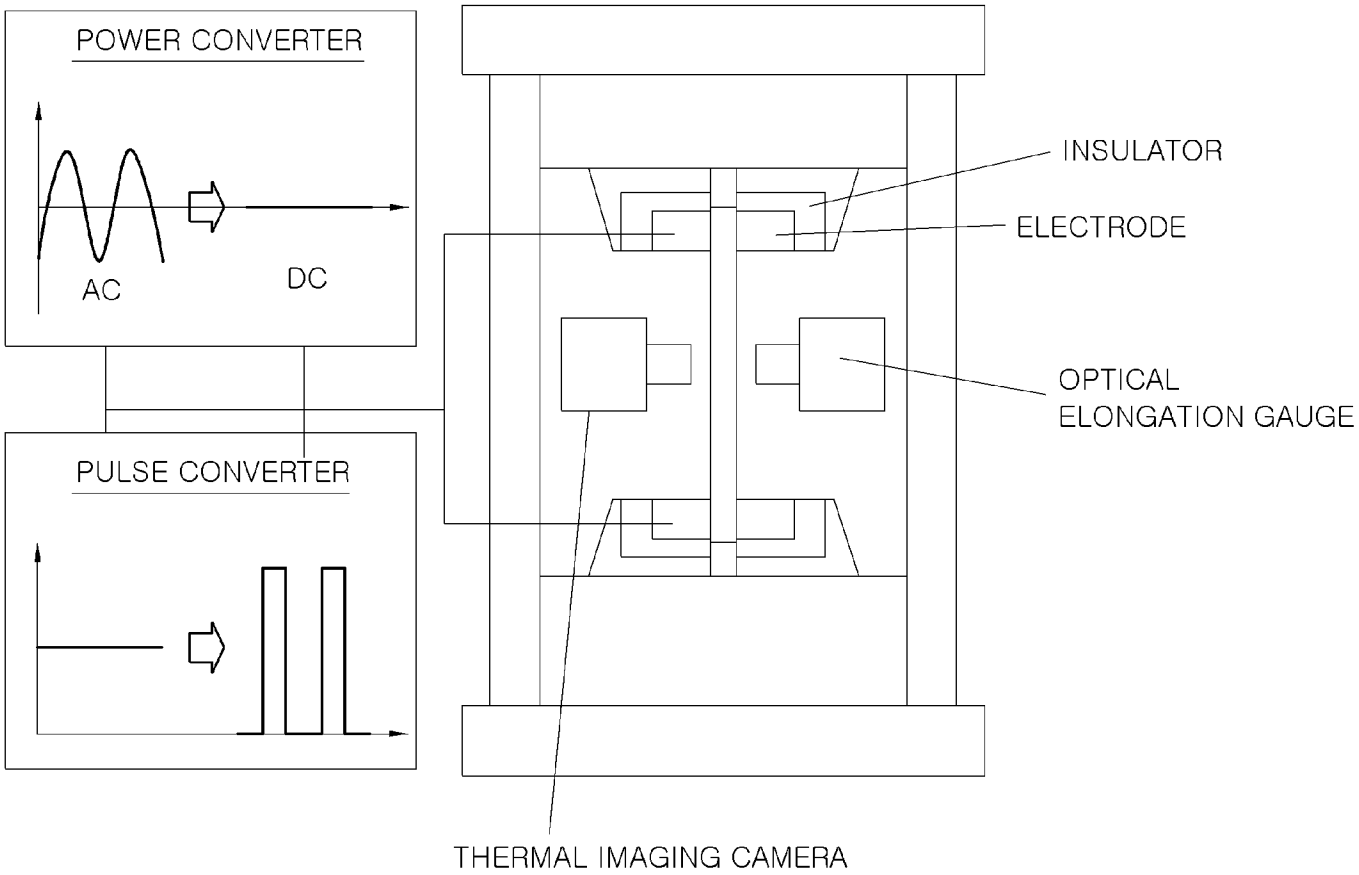
FIG. 6 schematically illustrates a test apparatus for verifying a forming method of an aluminum plate according to an exemplary embodiment of the present disclosure.
Figure 7:
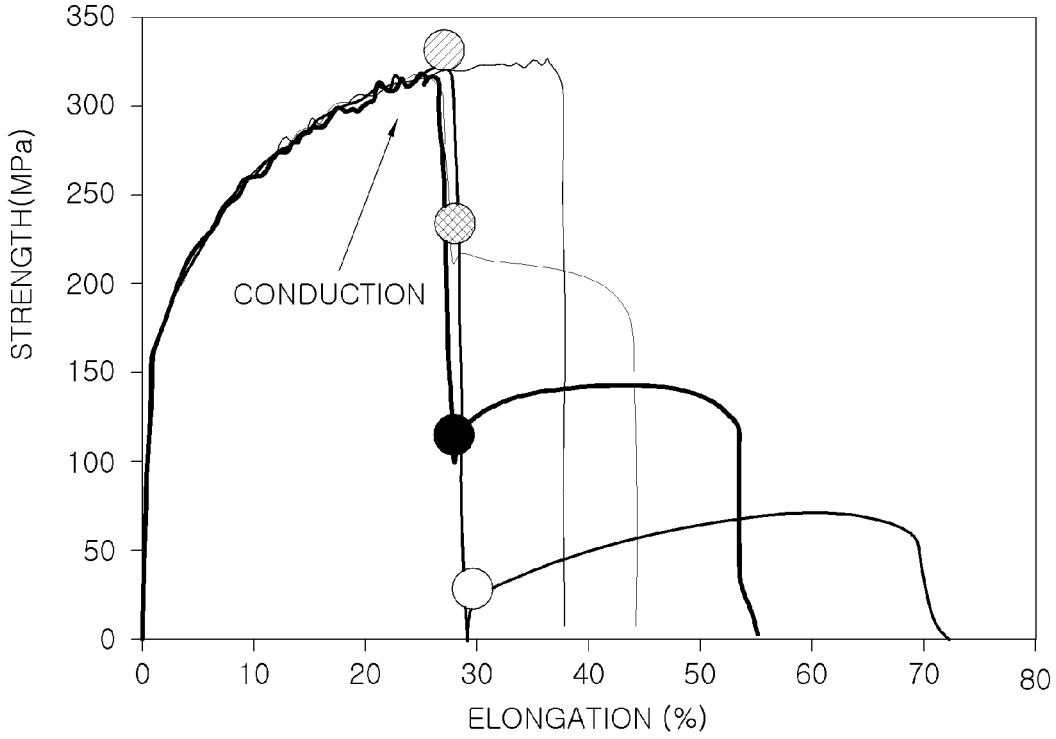
FIG. 7 illustrates a test result of an elongation change depending on energizing current according to an exemplary embodiment of the present disclosure.

This principle was confirmed experimentally through a test apparatus illustrated in FIG. 6. As illustrated in FIG. 6, a current was applied to a plate through a power converter and a pulse converter, the elongation was measured with an optical elongation gauge, and a texture of a material was photographed by a thermal imaging camera. The current was prevented from flowing through an insulator between an electrode and a die. A test material was a 5,000-series aluminum plate, and the current was applied at an elongation of 28%. A result of the elongation with respect to the applied current is summarized in FIG. 7 and Table 1 below.

TABLE 1

| | Conduction current ($A/mm^2$) | Conduction time (s) | Temperature (° C.) | Elongation (%) |
|---|---|---|---|---|
| | Non-conduction | | 37.9 | |
| | 80~90 | 0.5~0.9 | 200 | 44.4 |
| | 100~120 | 0.5~0.9 | 280 | 55.2 |
| | 120~140 | 0.5~0.9 | 360 | 72.2 |

Figure 8:
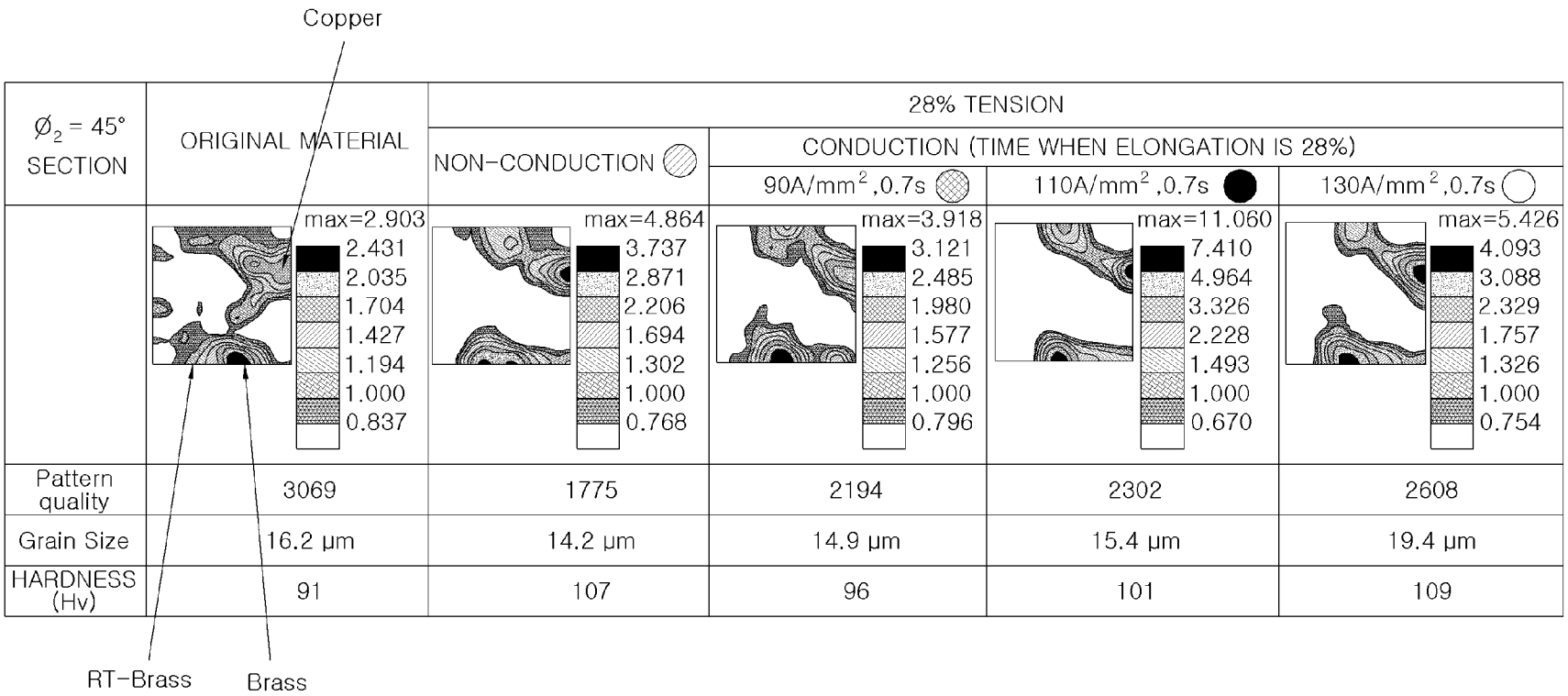
FIG. 8 illustrates a test result of a tissue change depending on the energizing current according to an exemplary embodiment of the present disclosure.

Temperatures for respective conduction current correspond to 200° C., 280° C., and 360° C., respectively, and the result indicates that the elongation is enhanced by a maximum of 34% over the non-conduction case. As illustrated in FIG. 8, a tissue analysis result immediately after conduction shows that a potential density decreases. When the current is applied, the potential density may decrease due to a temperature increase of the test specimen.

The potential density may be evaluated by a pattern quality in electron backscatter diffraction (EBSD). In particular, as the pattern quality becomes low, the potential density increases, and as the pattern quality becomes high, the potential density decreases. In other words, as referred in FIG. 8, although the pattern quality may not be increased to the original material level, the pattern quality may be increased compared with the non-conduction case. As a result, the potential density may decrease, and consequently, the elongation may be enhanced.

Meanwhile, although the potential density is not restored to the original material level, the elongation may be substantially restored, which indicates that there may be an additional factor other than the potential density that enhances the elongation. Consequently, it may be seen that the elongation is enhanced due to a change in texture as referred in FIG. 8. In other words, a rotated brass (RT Brass) texture may be grown when the current is applied, and the elongation may be enhanced due to a growth of the rotated brass texture. The rotated brass texture may be grown due to occurrence of an abnormal crystal grain in which a grain size increases without a decrease in hardness.

Figure 9:
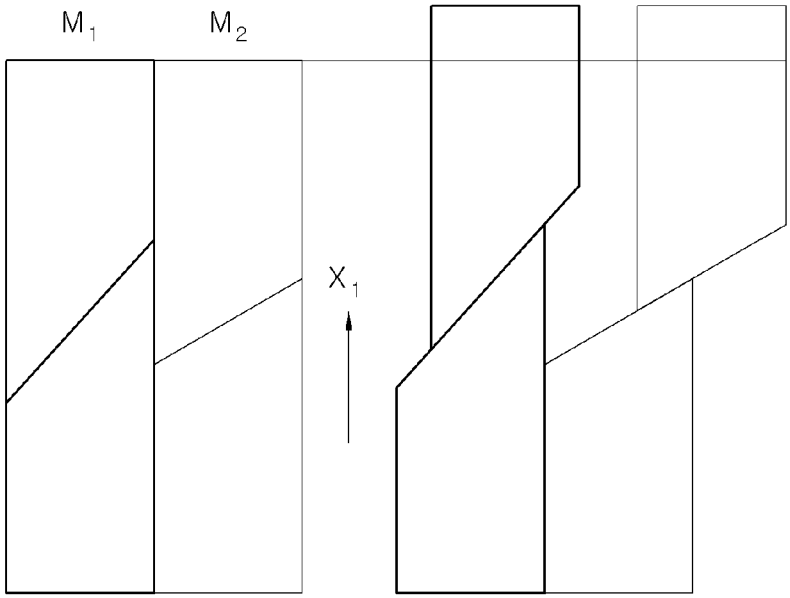
FIG. 9 is a diagram for describing a relationship between the tissue change and an elongation according to an exemplary embodiment of the present disclosure.

A relationship between the rotated brass texture and the elongation is described by a slip system illustrated in FIG. 9. Taylor Factor (M), a numerical value that represents a degree to which the slip system moves to produce a constant strain, may be represented as Equation 1 below, where $d\gamma^{(k)}$ is an amount of incremental shear on the slip plane of a given grain, $d\varepsilon_{ij}$ is a plastic strain increment applied externally.

$$M = \frac{\sum d\gamma^{(k)}}{d\varepsilon_{ij}} \propto \text{Stored Energy} \qquad \text{Equation 1}$$

In FIG. 9, where $M_1<M_2$, the slip system (potential) movement is small, as the Taylor Factor is small, when deformation occurs. For a reference, the Taylor Factors for FT Brass, Brass, and Copper are 3.03, 3.57, and 3.43, respectively. Consequently, when the RT-Brass texture grows, the movement of the slip system to produce a predetermined deformation is minimal, and as a result, an increase in potential density is minimal, thereby enhancing the elongation.

An index of a bar type on a right side of a texture photographing image of FIG. 8 indicates that a size of a particle is greater from the bottom to the top, and the image is divided and shown by the index. As referred in FIG. 8, in the case of the non-conduction, a fraction is approximately 10%, but in the case of the conduction, the fraction is about 20 to 40%, and as a result, the potential density decreases, which indicates that the current may be applied to restore the elongation to an original material state.

Based on the above-mentioned test result, an electrode may be provided in a metal die to apply the current, and when an aluminum plate is deformed to a particular level by a forming metal die, the aluminum plate may be substantially deformed by a product shape and the current may be applied to a portion where a crack may occur to restore the elongation, and the forming may be performed again to process the part without the change in product shape and the crack.

Figure 10:
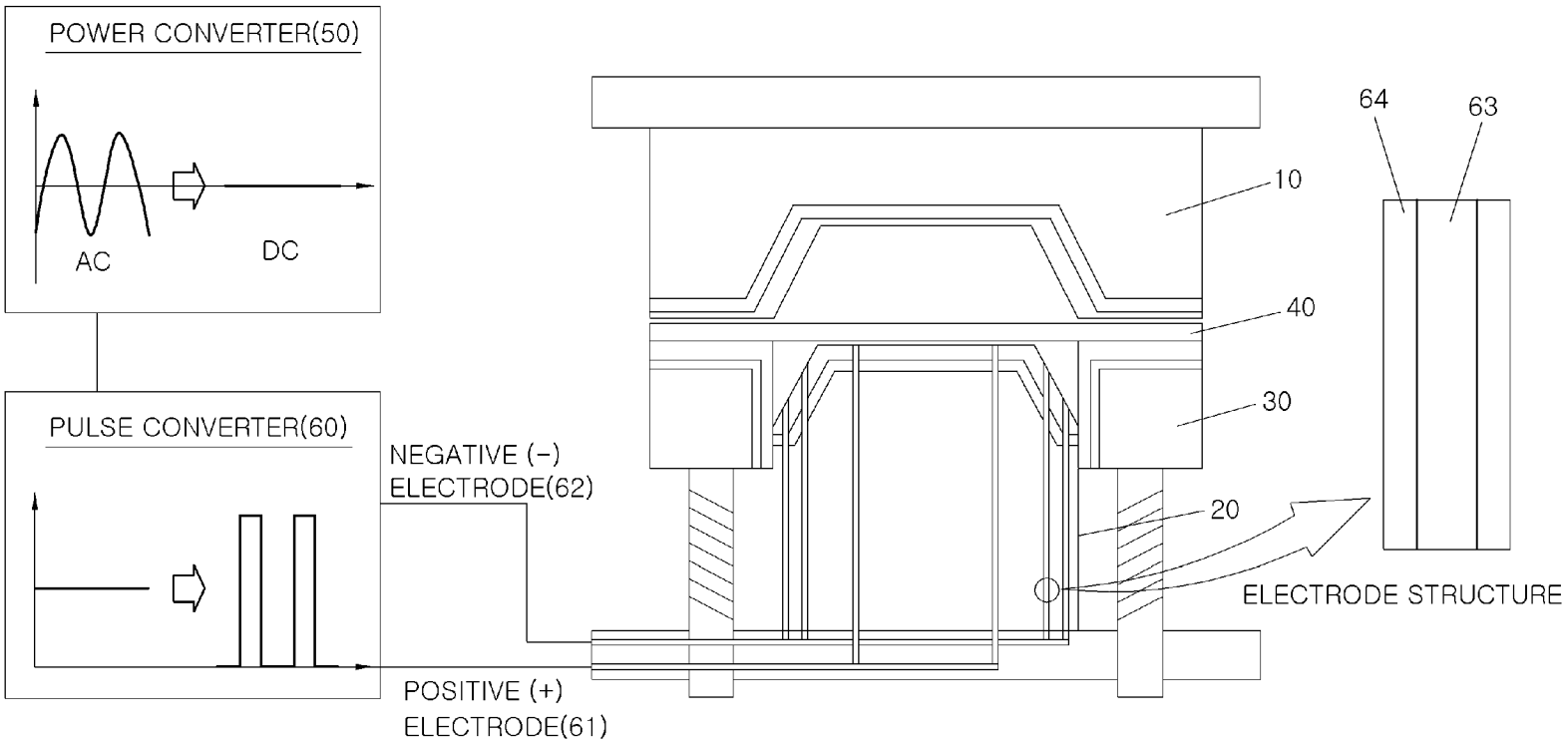
FIG. 10 schematically illustrates an apparatus for forming an aluminum plate according to an exemplary embodiment of the present disclosure.
Figure 11:
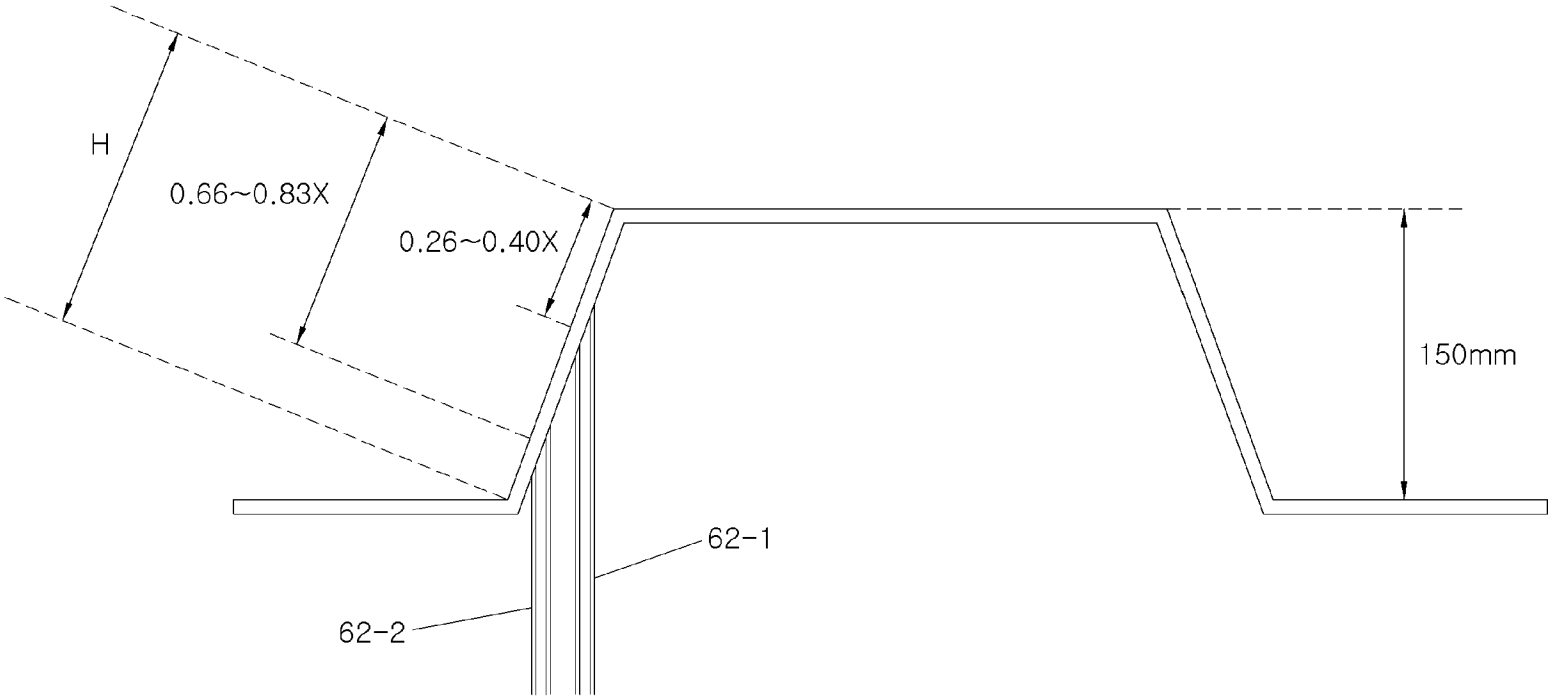
FIG. 11 illustrates a part of a lower die of FIG. 10 according to an exemplary embodiment of the present disclosure.

Therefore, a forming apparatus of the aluminum plate may have a configuration illustrated in FIG. 10. In addition, FIG. 11 illustrates a part of a lower die of FIG. 10. FIGS. 12A to 12D sequentially illustrate a method for forming an aluminum plate according to an exemplary embodiment of the present disclosure, and FIG. 13 is a diagram that describes a current application duration during a forming process. Hereinafter, an apparatus and a method for forming an aluminum plate according to an exemplary embodiment of the present disclosure will be described with reference to FIGS. 10 to 13.

The apparatus for forming an aluminum plate according to an exemplary embodiment of the present disclosure may include an upper die 10, a lower die 20, a blank holder 30, a current supply unit, and an electrode unit. The upper die 10 and the lower die 20 may include a tool steel which is a conductor. The upper die 10 may include a bottom shape that corresponds to a top shape of the product shape to be formed and may be lowered by a press to press and form an aluminum plate 40. The lower die 20 may include the top shape that corresponds to the bottom shape of the product shape to be formed and may be coupled and supported on the bolster. The blank holder 30 may be mounted on the bolster by using a cushion pin outside the lower die 20.

The current supply unit may include a power converter 50 and a pulse converter 60. An alternating current (AC) type current may be changed to a direct current (DC) type by the power converter 50 and converted into a pulse type by the pulse converter 60 again, which allows current to flow through an electrode part. The electrode part may include a positive (+) electrode 61 and a negative (−) electrode 62 and inserted into the lower die 20 to allow the current to flow between both electrodes through the conductor. Further, an electrode 63 may be inserted into the lower die 20 with the insulator 64 that surrounds the electrode 63 to prevent the current from flowing to the lower die 20, and as a result, the electrode 63 may be electrically isolated from the lower die 20.

The electrodes 61 and 62 drawn out from the current supply unit may be inserted into the lower die 20 and inserted with ends of the electrode 61 and 62 to be exposed on the upper surface of the lower die 20. Therefore, the current that flows through the electrodes 61 and 62 may be prevented from flowing into the lower die 20, and instead, may be directed to flow on the aluminum plate 40 in contact with the aluminum plate 40 to be deformed and seated on the upper surface of the lower die 20.

Referring to FIGS. 10 and 11, the positive (+) electrode 61 may be inserted into the lower die 20 and exposed to the upper surface of the lower die 20 as two electrodes. The positive (+) electrode 61 may be provided as two electrodes since a bent surface of the product may be present on both sides in the case of an example. In addition, the negative (−) electrode 62 may include a first negative (−) electrode 62-1 and a second negative (−) electrode 62-2 for each positive (+) electrode and exposed to the upper surface of the lower die 20 to selectively apply the current to the negative (−) electrode. In particular, the negative (−) electrode 62 may be exposed on the bent surface, which is a forming surface for forming the aluminum plate 40, on the upper surface of the lower die 20, to flow the current between the positive (+) and negative (−) electrodes, thereby locally applying the current to the aluminum plate 40.

The forming method of the aluminum plate by the forming apparatus of the aluminum plate having a configuration described above is illustrated in FIGS. 12A through 12D sequentially. First, the aluminum plate 40 may be seated on the blank holder 30 and thereafter, the upper die 10 may descend for forming by the lower die 20 and may grip an outer periphery of the aluminum plate 40 together with the blank holder 30. The blank holder 30 may be forced by the cushion pin in the direction of the upper die 10 in the same direction as the pressure of the upper die 10. In operation of the die during product forming, the lower die 20 may be fixed, and the upper die 10 that is operated by hydraulic pressure of a press machine may descend, and the lower die 20 may form the aluminum plate 40 by the movement of the blank holder 30 which descends while maintaining a close contact (e.g., abutting contact) with the upper die 10 to grip the aluminum plate 40.

Figure 12A:
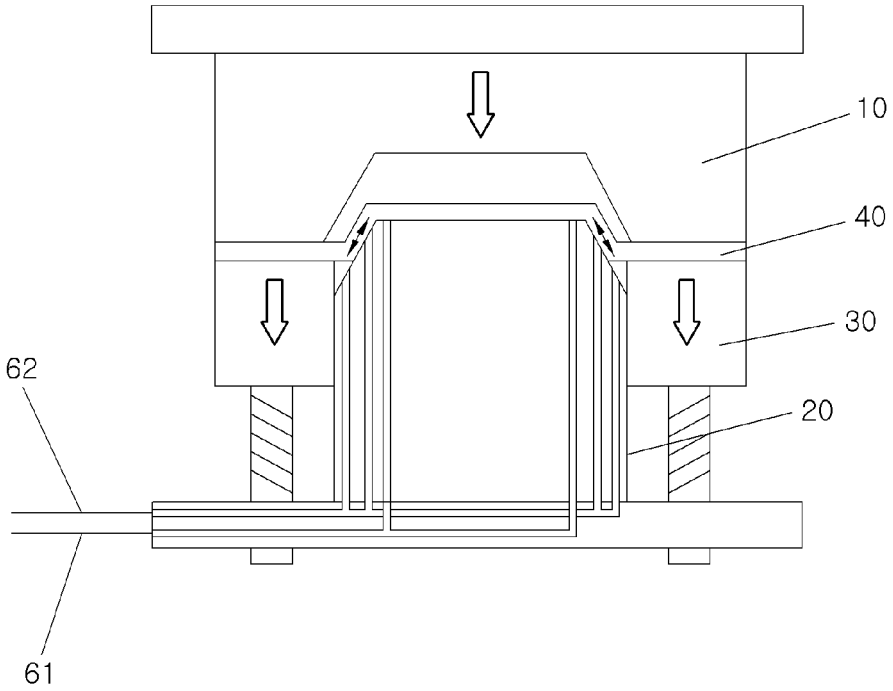
FIGS. 12A to 12D sequentially illustrate a method for forming an aluminum plate according to an exemplary embodiment of the present disclosure.
Figure 12B:
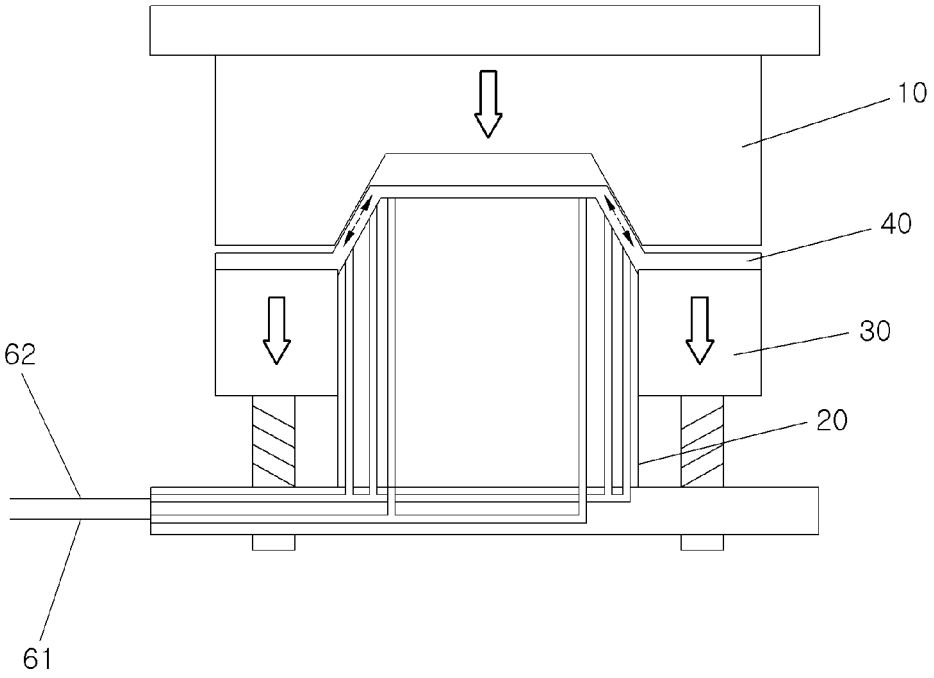
Figure 12C:
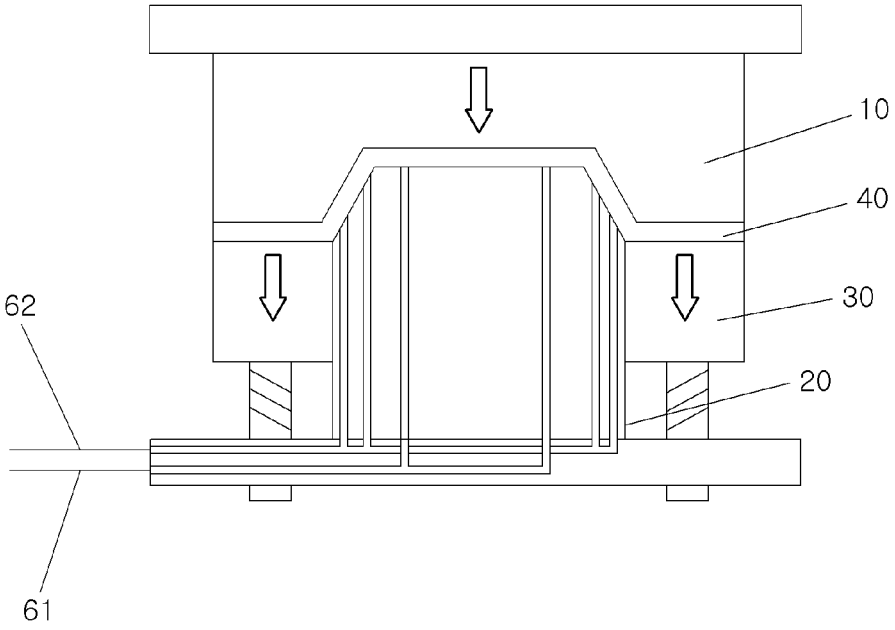
Figure 12D:
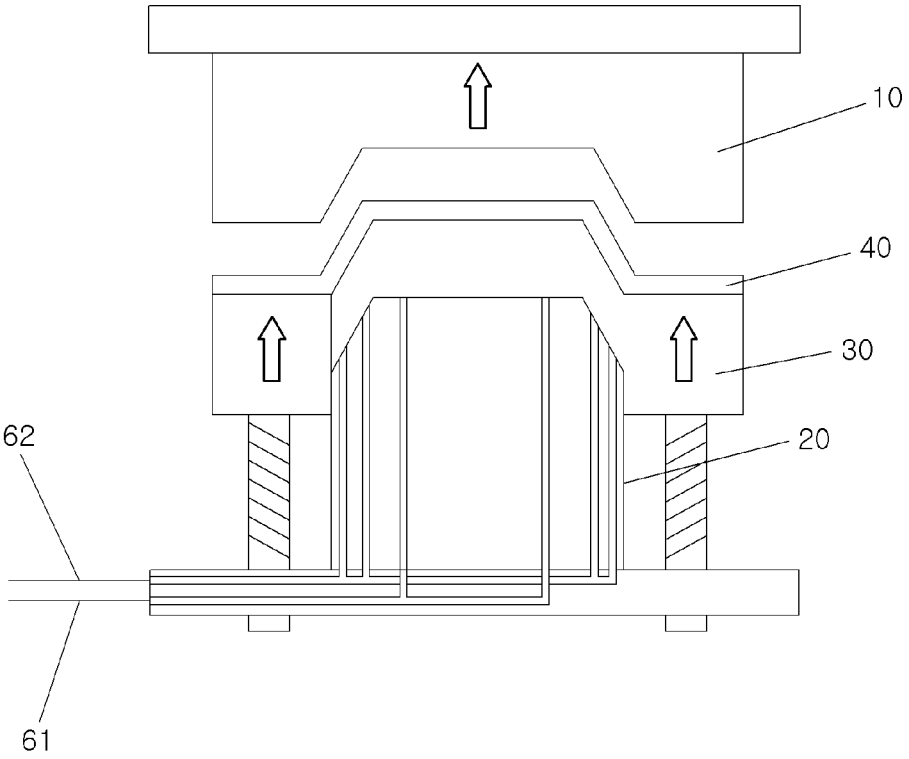
Figure 13:
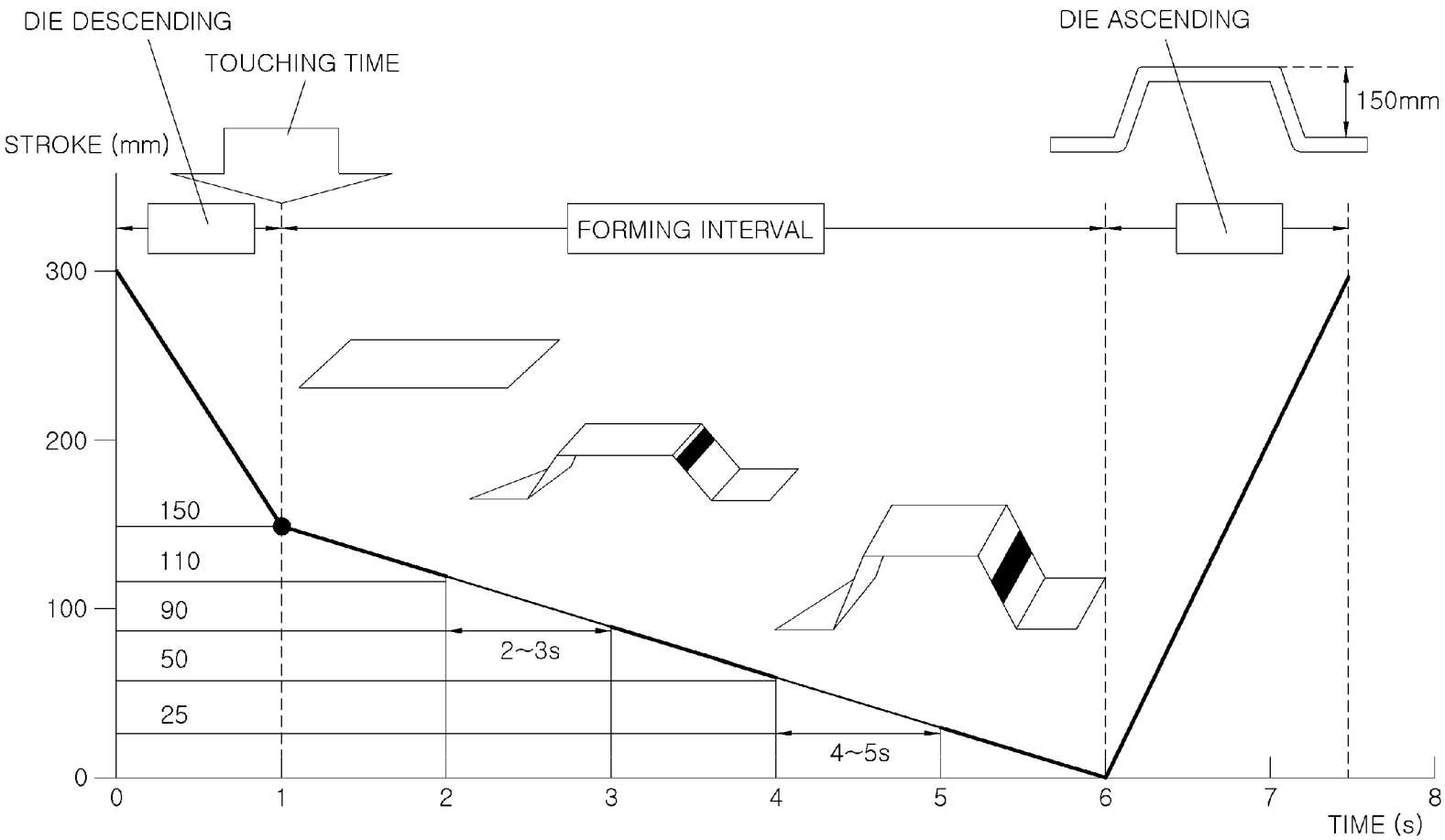
FIG. 13 is a diagram that describes a current application duration during forming according to an exemplary embodiment of the present disclosure.

FIG. 12A illustrates a step of applying a primary current through a first negative (−) electrode and FIG. 12B illustrates a step of applying a secondary current through a second negative (−) electrode. In FIG. 12C, when the forming is completed, the aluminum plate may be withdrawn by placing the die to an original location as illustrated in FIG. 12D, and then subjected to the same steps of trimming, piercing, flanging, and the like, as a general press process to manufacture finished products.

In the application of the primary current, a current of about 120 to 140 A/mm$^2$ for about 0.5 to 0.9 seconds may be applied to the positive (+) electrode 61 and the first negative (−) electrode 62-1 at an upper end portion on the bent surface which is substantially deformed while forming a portion marked with a thick line of the bent surface in FIG. 13 when the forming of the aluminum plate 40 has been completed by about 26 to 40% with respect to the finished product to restore the elongation of the aluminum plate to the original material level before forming the aluminum plate.

As illustrated in FIG. 13, with respect to the finished product in which the forming is completed, a forming depth of the finished product may be about 300 mm and a time may be about 7.5 seconds, based on a press stroke and genuinely forming the product, and the forming depth may be about 150 mm and the time may be about 6 seconds based on the stroke. In addition, a time when the forming is completed by about 26 to 40% may correspond to about 2 to 3 seconds after the start of the descending of the upper die based on the 8 SPM press.

Since the electric conductivity of the aluminum plate in an application of current is greater than that of the upper die and the lower die made of iron, most current may flow to the aluminum plate and the current may be prevented from flowing to the press equipment by the insulator 64 described above. Further, since a distance between two positive (+) electrodes 61 is greater than the distance between the positive (+) electrode 61 and the negative (−) electrode 62, little or no current may flow on the upper surface of the product.

Sequentially, in the application of the secondary current, a current of about 120 to 130 A/mm$^2$ may be applied to the positive (+) electrode 61 and the second negative (−) electrode 62-2 at a middle area on the bent surface which is substantially deformed at the time of forming a portion marked with a thick line of the bent surface in FIG. 13 when the forming of the aluminum plate 40 has been completed by about 66 to 83% with respect to the finished product to restore the elongation of the aluminum plate to the original material level before forming the aluminum plate. A time when the forming is completed by about 66 to 83% may correspond to about 4 to 5 seconds after the start of the descending of the upper die based on the 8 SPM press.

Particularly, since a portion where deformation is more likely to occur when the secondary current is applied increases than when the primary current is applied, the current may be applied to the entire bent surface of the aluminum plate 40. In addition, the current may be withdrawn from being applied to the first negative (−) electrode 62-1, thereby facilitating the flow of the current.

In summary, as illustrated in FIG. 13, in most mechanical presses, since it may take about 6 seconds to form the product on the basis of 8 SPM, to restore the elongation by applying the current twice to aluminum, considering that the current is applied to the product which is formed and the time to apply the current is less than 1 second, the application of the primary current may be performed in about 2 to 3 seconds, and the application of the secondary current may be performed in about 4 to 5 seconds for which the forming is performed after applying the primary current.

Further, since the electrode may be positioned at a position where the forming is likely to be performed in the process of the forming as illustrated in FIG. 11 and may be positioned to correspond to a location of a material deformed when the current is applied, the first negative (−) electrode 62-1 may be positioned at the point of about 0.26× to 0.4× based on a length x of the bent surface of the finished product and the second negative (−) electrode 62-2 may be positioned at the point of about 0.66× to 0.83× based on the length x of the bent surface of the finished product.

To replace the steel plate of the same strength (elongation 63.6%), the 5000-series aluminum plate may be energized in the range of about 120 to 140 A/mm$^2$ and about 0.5 to 0.9 seconds to recover an elongation of 63.6%. To overcome a limit of product forming due to a low elongation of an aluminum plate, a warm forming method is used in the related art, in which a product shape is changed based on room temperature forming or forming is performed at a high temperature (350 to 400° C.) at which an elongation increases without changing the product shape, but the warm forming method has a disadvantage that a product processing speed is slow due to a process of evenly heating the entire aluminum plate with high-temperature gas in a die, and as a result, cost significantly increases.

Conversely, in an apparatus and a method for forming an aluminum plate according to an exemplary embodiment of the present disclosure, an elongation of the aluminum plate may be restored by applying a current for a short duration during the forming to enhance processability and to prevent the cost increase. In addition, since the current may be applied locally and sequentially in accordance with a forming step of a plate, it is more advantageous in terms of processability and cost. Further, since a minimum electrode arrangement required for local current application is provided, the inflow of current to a die may be minimized Meanwhile, use of an insulator for insulation against an electrode of the die may be minimized.

The foregoing exemplary embodiments are merely examples to allow a person having ordinary skill in the art to which the present disclosure pertains (hereinafter, referred to as those skilled in the art) to easily practice the present disclosure. Accordingly, the present disclosure is not limited to the foregoing exemplary embodiments and the accompanying drawings, and therefore, a scope of the present disclosure is not limited to the foregoing exemplary embodiments. Accordingly, it will be apparent to those skilled in the art that substitutions, modifications and variations may be made without departing from the spirit and scope of the disclosure as defined by the appended claims and may also belong to the scope of the present disclosure.

What is claimed is:

1. An apparatus for forming an aluminum plate, comprising:

an upper die having a bottom surface that corresponds to a top shape of a product to be formed, wherein the upper die is configured to descend by a press to press the aluminum plate;

a lower die having an upper surface that corresponds to a bottom shape of the product; and a plurality of positive (+) electrodes and a plurality of negative (−) electrodes inserted into the lower die and exposed on the upper surface of the lower die, wherein the plurality of positive (+) electrodes and the plurality of negative (−) electrodes are exposed on the upper surface of the lower die at a portion that corresponds to a bent surface of the product, wherein the plurality of positive (+) electrodes includes a first positive (+) electrode and a second positive (+) electrode, wherein the plurality of negative (−) electrodes includes a first negative (−) electrode electrically connected the first positive (+) electrode and a second negative (−) electrode electrically connected the first positive (+) electrode, wherein a primary current is applied through each of the plurality of positive electrodes (+) and the first negative electrode (−), and a secondary current is applied through each of the plurality of positive electrodes (+) and the second negative electrode (−), wherein when a length of the bent surface is x, the first negative (−) electrode is exposed on the upper surface of the lower die at a first position that corresponds to a point of 0.26x from 0.4x from an upper end of the bent surface toward a lower surface of the lower die, and a second negative (−) electrode is exposed on the upper surface of the lower die at a second position that corresponds to a point of 0.66x to 0.83x from the upper end of the bent surface toward the lower surface of the lower die.

2. The apparatus of claim 1, wherein the plurality of positive (+) electrodes, the first negative (−) electrode, and the second negative (−) electrode are surrounded by an insulator and inserted into the lower die.

3. A method for forming an aluminum plate, comprising:

seating the aluminum plate on a lower die having an upper surface that corresponds to a bottom shape of a product to be formed;

lowering an upper die having a lower surface that corresponds to a top shape of the product and pressing the aluminum plate seated on the lower die;

applying a primary current through a positive (+) electrode and a first negative (−) electrode among a plurality of negative (−) electrodes inserted into the lower die and exposed on the upper surface of the lower die at a portion that corresponds to a bent surface of the product; and applying a secondary current through the positive (+) electrode and a second negative (−) electrode among the plurality of negative (−) electrodes after the applying the primary current;

wherein, when a length of the bent surface is x, the first negative electrode (−) is exposed on the upper surface of the lower die at a first position that corresponds to a point of 0.26x to 0.4x from an upper end of the bent surface toward a lower surface of the lower die, and wherein the second negative (−) electrode is exposed on the upper surface of the lower die at a second position that corresponds to a point of 0.66x to 0.83x from the upper end of the bent surface toward the lower surface of the lower die.

4. The method of claim 3, wherein in the applying the primary current, the primary current is applied when a progress rate of the pressing of the aluminum plate is about 26 to 40% with respect to a completion of the product forming.

5. The method of claim 4, wherein in the applying the primary current, the primary current of about 120 to 140A/mm2 is applied for about 0.5 to 0.9 seconds.

6. The method of claim 2, wherein in the applying the secondary current, the secondary current is applied when the progress rate of the pressing of the aluminum plate is about 66 to 83% with respect to the completion of the product forming.

7. The method of claim 6, wherein in the applying the secondary current, the secondary current of about 120 to 140A/mm2 is applied for about 0.5 to 0.9 seconds.

8. The method of claim 3, wherein in the applying the primary current, the primary current is applied about 2 to 3 seconds after the lowering the upper die.

9. The method of claim 8, wherein in the applying the primary current, the primary current of about 120 to 140A/mm2 is applied for about 0.5 to 0.9 seconds.

10. The method of claim 3, wherein in the applying the secondary current, the secondary current is applied about 4 to 5 seconds after the lowering the upper die.

11. The method of claim 10, wherein in the applying the secondary current, the secondary current of about 120 to 140A/mm2 is applied for about 0.5 to 0.9 seconds.

* * * * *